US009695001B2

(12) United States Patent
Iesaki

(10) Patent No.: US 9,695,001 B2
(45) Date of Patent: Jul. 4, 2017

(54) CONTROL SYSTEM

(71) Applicant: Brother Kogyo Kabushiki Kaisha, Nagoya-shi, Aichi-ken (JP)

(72) Inventor: Kenichi Iesaki, Ichinomiya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 15/073,721

(22) Filed: Mar. 18, 2016

(65) Prior Publication Data

US 2016/0289026 A1 Oct. 6, 2016

(30) Foreign Application Priority Data

Mar. 31, 2015 (JP) ..... 2015-074018

(51) Int. Cl.
*B65H 7/02* (2006.01)
*B65H 9/00* (2006.01)

(52) U.S. Cl.
CPC ..... *B65H 7/02* (2013.01); *B65H 9/006* (2013.01); *B65H 2511/22* (2013.01); *B65H 2513/512* (2013.01); *B65H 2515/30* (2013.01); *B65H 2701/1311* (2013.01)

(58) Field of Classification Search
CPC ..... B65H 9/06; B65H 2513/512
See application file for complete search history.

(56) References Cited

U.S. PATENT DOCUMENTS

2007/0023994 A1* 2/2007 Mandel ..... B65H 9/002 271/226
2013/0094888 A1* 4/2013 Maeshima ..... B65H 7/08 399/388

FOREIGN PATENT DOCUMENTS

| | | | |
|---|---|---|---|
| JP | S64-017741 | A | 1/1989 |
| JP | H04-137017 | A | 5/1992 |
| JP | H07-040508 | B2 | 5/1995 |
| JP | 2014-134485 | A | 7/2014 |

OTHER PUBLICATIONS

Machine English Translation of JP pub. No. S64-017741A.
Machine English Translation of JP pub No. H04-137017A.

* cited by examiner

*Primary Examiner* — Howard Sanders
(74) *Attorney, Agent, or Firm* — Banner & Witcoff, Ltd.

(57) ABSTRACT

A control system for pressing an abutting object against an abutted object includes: a mechanical device including a motor and causing a force from the motor to act on the abutting object to displace the abutting object toward the abutted object, a driving device driving the motor according to an inputted operation amount, a measuring device measuring a physical amount related to displacement of the abutting object, and a controller. The controller executes: a position control process to calculate the operation amount to be inputted to the driving device, a reaction force estimation process to estimate a reaction force acting on the abutting object, and a compliance control process to correct the operation amount which is calculated in the position control process and to be inputted to the driving device by a compliance control based on an estimate value of the reaction force estimated in the reaction force estimation process.

18 Claims, 13 Drawing Sheets

| | Af<A1 | A1≦Af<A2 | A2≦Af |
|---|---|---|---|
| Ftar | Ft1 | Ft2 | Ft3 |
| Th | Th1 | Th2 | Th3 |

CONTROL SYSTEM

CROSS REFERENCE TO RELATED APPLICATION

The present application claims priority from Japanese Patent Application No. 2015-074018, filed on Mar. 31, 2015, the disclosure of which is incorporated herein by reference in its entirety.

BACKGROUND

Field of the Invention

The present invention relates to a control system for pressing an abutting object against an abutted object.

Description of the Related Art

There are conventionally known systems which correct oblique motions of sheets by pressing the sheets against a nip portion of a conveyance roller so as to align the anterior ends of the sheets with the nip portion of the conveyance roller (see Japanese Patent Application Laid-open No. 64-017741, for example).

SUMMARY

In order for the nip portion of the conveyance roller to correct the oblique motions of the sheets, the anterior ends of the sheets are pressed against the nip portion of the conveyance roller by further sending out the sheets after letting the sheets contact with the nip portion. However, if the sheets are sent out more than necessary, then an excessive force may be applied to the sheets so as to bend the anterior ends of the sheets and/or result in a jam. On the other hand, if the sheets are sent out insufficiently, then the oblique motions of the sheets are not adequately corrected. In this manner, in order to appropriately correct the oblique motions of the sheets, it is necessary to send out the sheets neither excessively nor insufficiently.

However, it is possible for those systems mentioned above to give rise to an insufficient send-out amount when the roller sending out the sheets slips with respect to the sheets as the roller sensing out the sheets is set at a certain rotation amount to correspond to the send-out amount of the sheets for carrying out transport control of the sheets. Further, because the appropriate send-out amount varies with the thickness, material and the like of the sheets, it is difficult to correct the oblique motions by appropriately pressing the sheets against an abutted object.

Further, without being limited to the sheets, when any abutting object is pressed against any abutted object, in order to suppress the impact, it is preferable to moderately press the abutting object against the abutted object. It is possible for any intensive impact to cause damage to part of the abutting object. For example, when the sheets are caused to contact with the nip portion, it is possible to bend the sheets.

Accordingly, it is an object of the present teaching to provide a control system capable of appropriately pressing an abutting object against an abutted object.

According to an aspect of the present teaching, a control system for pressing an abutting object against an abutted object includes a mechanical device, a driving device, a measuring device, and a controller. The mechanical device includes a motor. The mechanical device causes a force from the motor to act on the abutting object so as to displace the abutting object toward the abutted object. The driving device drives the motor according to an inputted operation amount.

The measuring device measures a physical amount related to the displacement of the abutting object.

The controller executes a position control process, a reaction force estimation process, and a compliance control process. In the position control process, the controller calculates the operation amount to be inputted to the driving device, based on a deviation between a measured position of the abutting object specified from the physical amount measured by the measuring device, and a target position according to a target position trajectory.

In the reaction force estimation process, the controller estimates a reaction force acting on the abutting object. The controller can estimate the reaction force not including a friction component produced in a power transmission system from the motor to the abutting object, depending on a relationship between the operation amount and the physical amount measured by the measuring device.

In the compliance control process, the controller corrects the operation amount which is calculated in the position control process and to be inputted to the driving device, by a compliance control based on an estimate value of the reaction force estimated in the reaction force estimation process.

If the abutting object begins to contact with the abutted object, then there is an increase in the reaction force acting on the abutting object. On this occasion, because the controller corrects the operation amount to follow the reaction force by way of the compliance control, it is possible to prevent the reaction force from exerting intensive impact on the abutting object. Moreover, according to the control system, the reaction force is estimated depending on a relationship between the operation amount and the physical amount measured by the measuring device, and the estimate value is used to correct the operation amount based on the compliance control; therefore, no force sensor, as additional hardware, is needed. Therefore, according to the above aspect of the present teaching, it is possible to provide a significant control system for pressing the abutting object against the abutted object.

The compliance control mentioned above may be carried out according to a well-known principle. That is, it may be configured that in the compliance control process, the controller uses the estimate value to correct the operation amount inputted to the driving device in the position control process, based on a model which denotes a correspondence relation between the estimate value and a correction amount for the operation amount and which is defined by a virtual spring property and damper property between the abutting object and the abutted object, and by an inertia property of the mechanical device and the abutting object.

For example, it may be configured that in the compliance control process, the controller corrects the operation amount inputted to the driving device in the position control process in such a direction as to displace the target position trajectory by a positional correction amount Xc corresponding to an estimate value Fr of the reaction force, according to a transfer function including a value Kc denoting a virtual spring property between the abutting object and the abutted object, a value Dc denoting a virtual damper property between the abutting object and the abutted object, a value Jc denoting an inertia property of the mechanical device and the abutting object, and a correction coefficient Kf.

It is possible to adopt the following function, for example, as the transfer function. Here, s is the Laplace operator.

Formula (1)

$$G(s) = \frac{Xc}{Fr} = \frac{Kf}{Jc \cdot s^2 + Dc \cdot s + Kc} \quad (1)$$

In this case, it may be configured that the controller sets a position (Xa+(Kf/Kc)·Ftar), in the position setting process, as the target stop position corresponding to the target reaction force, based on a target reaction force Ftar and a position Xa which is the measured position or the target position on the occasion when the estimate value satisfies a predetermined condition. If supposedly the abutting object is at a stop, then it is possible to replace the Laplace operator s with zero. As described above, the target stop position may be set according to the relation depicted in the formula (1) for this occasion.

DESCRIPTION OF THE EMBODIMENT

Hereinbelow, a preferred embodiment of the present teaching will be explained with reference to the accompanying drawings.

Figure 1:
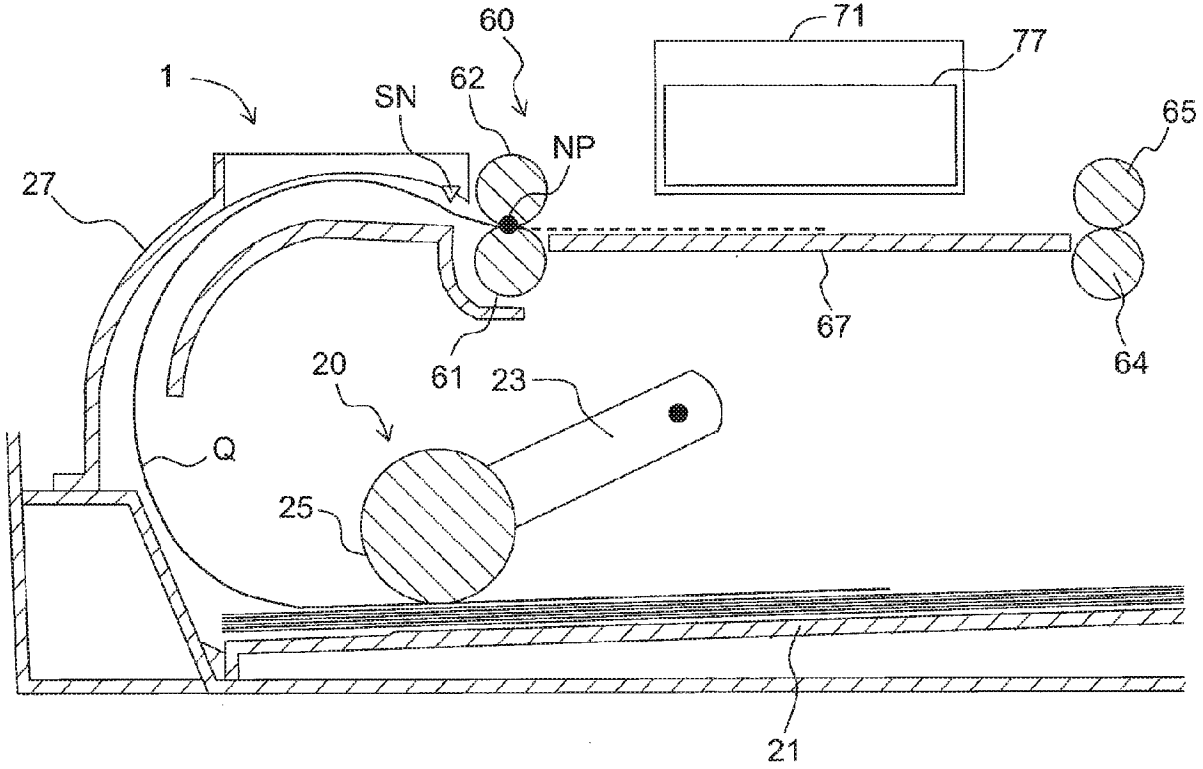
FIG. 1 depicts a mechanical configuration of a paper feed device and a paper transport device according to an embodiment of the present teaching.

An image formation system 1 depicted in FIG. 1 according to this embodiment is configured as, for example, an ink jet printer. This image formation system 1 transports rectangular sheets of paper Q loaded on a paper feed tray 21 after separating one of the sheets from another. The image formation system 1 forms image on the paper Q passing through below an ink jet head 77.

This image formation system 1 includes a paper feed device 20 as a mechanical device for transporting the paper Q, and a paper transport device 60. The paper feed device 20 includes the paper feed tray 21, an arm 23, and a paper feed roller 25. The paper feed device 20 separates one sheet of the paper Q from another in the paper feed tray 21 and transports the same downstream by way of the rotation of the paper feed roller 25. The arm 23 keeps the paper feed roller 25 in a rotatable state and, by its own weight or a biasing force from a spring, presses the paper feed roller 25 against the uppermost sheet of the paper Q in the paper feed tray 21. By the rotation of the paper feed roller 25, the paper Q transported downstream from the paper feed tray 21 is regulated by a U-turn path 27, and supplied to a nip portion NP between a conveyance roller 61 and a pinch roller 62.

A registration sensor SN is arranged in an upstream place from the nip portion NP on the paper transport path. The registration sensor SN outputs a detection signal according to whether or not the paper Q being about to enter the nip portion NP is positioned in a detection place short of the nip portion NP by a predetermined distance L. When the paper Q enters the nip portion NP from the paper feed tray 21, its anterior end is prevented by the nip portion NP from reaching to the downstream side from the nip portion NP in the paper transport path. By pressing the anterior of the paper Q against the nip portion NP, any oblique motion of the paper Q is corrected, and then the paper Q is finished with the registration operation (alignment operation).

After the paper Q supplied to the nip portion NP is finished with the above registration operation, the paper transport device 60 operates to transport the paper Q to pass through below the ink jet head 77. The paper transport device 60 includes the conveyance roller 61, the pinch roller 62, a paper discharge roller 64, and a spur roller 65. The pinch roller 62 is arranged to face the conveyance roller 61, while the spur roller 65 is arranged to face the paper discharge roller 64. The paper discharge roller 64 is arranged downstream from the conveyance roller 61 in the paper transport path. A platen 67 is arranged between the conveyance roller 61 and the paper discharge roller 64. The platen 67 supports from below the paper Q moving from the conveyance roller 61 toward the paper discharge roller 64.

The paper Q supplied from the paper feed device 20 to the nip portion NP is nipped between the conveyance roller 61 and the pinch roller 62, and transported downstream by the rotation of the conveyance roller 61. In particular, the paper Q is supported by the platen 67 and transported toward the paper discharge roller 64. The pinch roller 62 is driven to rotate along with the rotation of the conveyance roller 61. The paper Q having arrived at the paper discharge roller 64 is set between the paper discharge roller 64 and the spur roller 65 and transported downstream by the rotation of the paper discharge roller 64. The paper Q transported downstream by the paper discharge roller 64 is discharged to an undepicted paper discharge tray.

Being mounted on a carriage 71, the ink jet head 77 is arranged to face toward the platen 67. The ink jet head 77 moves reciprocatingly together with the carriage 71 in a main scanning direction (the normal direction to the page of FIG. 1) orthogonal to the paper transport direction. In the course of the reciprocating motion, the ink jet head 77 forms image on the paper Q passing through on the platen 67 by way of jetting liquid drops of ink downward.

Figure 2:
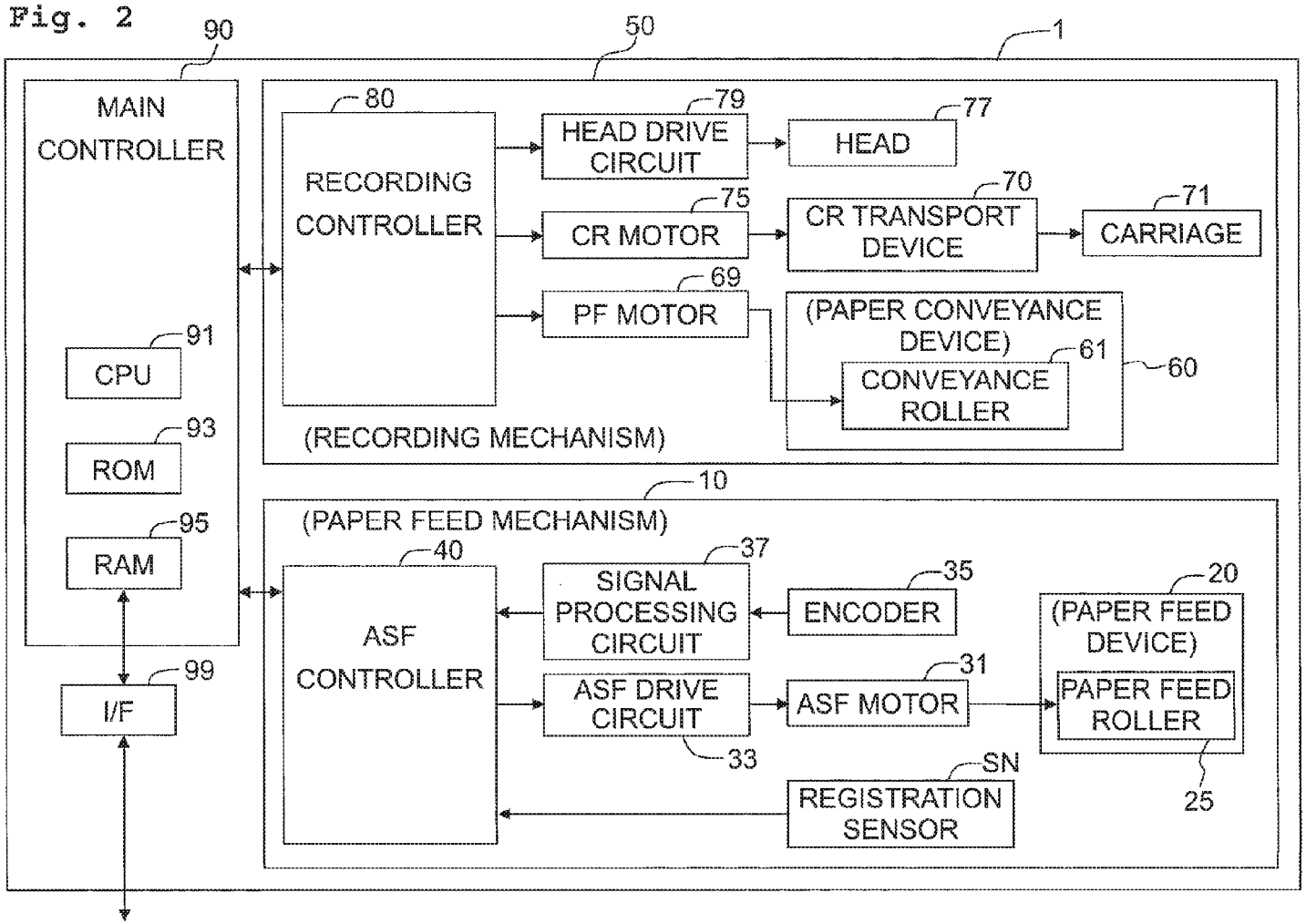
FIG. 2 is a block diagram depicting an overall configuration of an image formation system.

To give a detailed description, the image formation system 1 according to this embodiment includes, as depicted in FIG. 2, a paper feed mechanism 10, a recording mechanism 50, a main controller 90, and a communication interface 99. The paper feed mechanism 10 includes, in addition to the above paper feed device 20 and registration sensor SN, an ASF motor 31, an ASF drive circuit 33, a rotary encoder 35, a signal processing circuit 37, and an ASF controller 40.

The ASF motor 31 is a DC motor which serves to drive the paper feed roller 25 into rotation, and is driven by the ASF drive circuit 33. The ASF drive circuit 33 drives the ASF motor 31 in the manner of PWM to apply a drive current to the ASF motor 31, according to an operation amount U (a command value in the form of electric current) inputted from the ASF controller 40.

The rotary encoder 35 is arranged at the periphery of the rotary shaft of the paper feed roller 25 or at the periphery of the rotary shaft of the ASF motor 31, to output a pulse signal according to the rotation of the paper feed roller 25. Based on the output signal from the rotary encoder 35, the signal processing circuit 37 measures a rotational position X and a rotary speed V of the paper feed roller 25. Hereinbelow, a measured position Xm is used to express the measured value of the position X according to the signal processing circuit 37, while a measured speed Vm is used to express the measured value of the speed V. The measured position Xm denotes the rotation amount of the paper feed roller 25 from the point of starting to feed the paper. The measured position Xm is a physical amount indirectly denoting a displacement amount of the paper Q. That is, while some errors are included, the measured position Xm indirectly denotes a transport amount of the paper Q from the paper feed tray 21.

Following a command from the main controller 90, the ASF controller 40 calculates the operation amount U for the ASF motor 31, and inputs the same to the ASF drive circuit 33. By way of the calculation and input of the operation amount U, the ASF controller 40 controls the rotation of the paper feed roller 25. While a detailed description therefor will be made later on, based on an input signal from the registration sensor SN, the ASF controller 40 operates to switch the control method.

In addition, the recording mechanism 50 further includes a PF motor 69, a CR transport device 70, a CR motor 75, a head drive circuit 79, and a recording controller 80, other than the aforementioned paper transport device 60, carriage 71 and ink jet head 77. The recording mechanism 50 further includes a motor drive circuit, an encoder and a signal processing circuit all of which are not depicted and for which explanation will be omitted.

The PF motor 69 is a DC motor serving to drive the conveyance roller 61 included in the paper transport device 60 to rotate, and is controlled by the recording controller 80 via an undepicted drive circuit. The conveyance roller 61 and the paper discharge roller 64 are connected to each other via an undepicted belt mechanism. The paper discharge roller 64 rotates synchronously with the conveyance roller 61.

The CR transport device 70 receives a drive power from the CR motor 75 to reciprocatingly move the carriage 71 mounted with the ink jet head 77 in the main scanning direction. The CR motor 75 is a DC motor serving to apply the drive power to the CR transport device 70, and is controlled by the recording controller 80 via the undepicted drive circuit.

The head drive circuit 79 drives the ink jet head 77 to cause the ink jet head 77 to jet liquid drops of ink. Jetting the liquid drops of ink from the ink jet head 77 is controlled by the recording controller 80 via the head drive circuit 79. Following a command from the main controller 90, the recording controller 80 controls the operation of conveying the paper Q and the operation of forming image on the paper Q, by controlling the PF motor 69, the CR motor 75, and the head drive circuit 79.

The main controller 90 includes a CPU 91, a ROM 93 and a RAM 95 to overall control the image formation system 1. The CPU 91 carries out processes based on various programs stored in the ROM 93. The RAM 95 is used as a working memory when the CPU 91 carries out the processes.

On receiving a print target data from an external device via the communication interface 99, the CPU 91 of the main controller 90 inputs a command to the paper feed mechanism 10 and the recording mechanism 50 such that image may be formed on the paper Q based on the print target data. The communication interface 99 includes, for example, a USB interface and/or a LAN interface, and is configured to allow communication with the external device such as a personal computer or the like. Hereinbelow, an explanation will be made on the processes carried out by the CPU 91 of the main controller 90 as if the processes carried out by the main controller 90.

Figure 3:
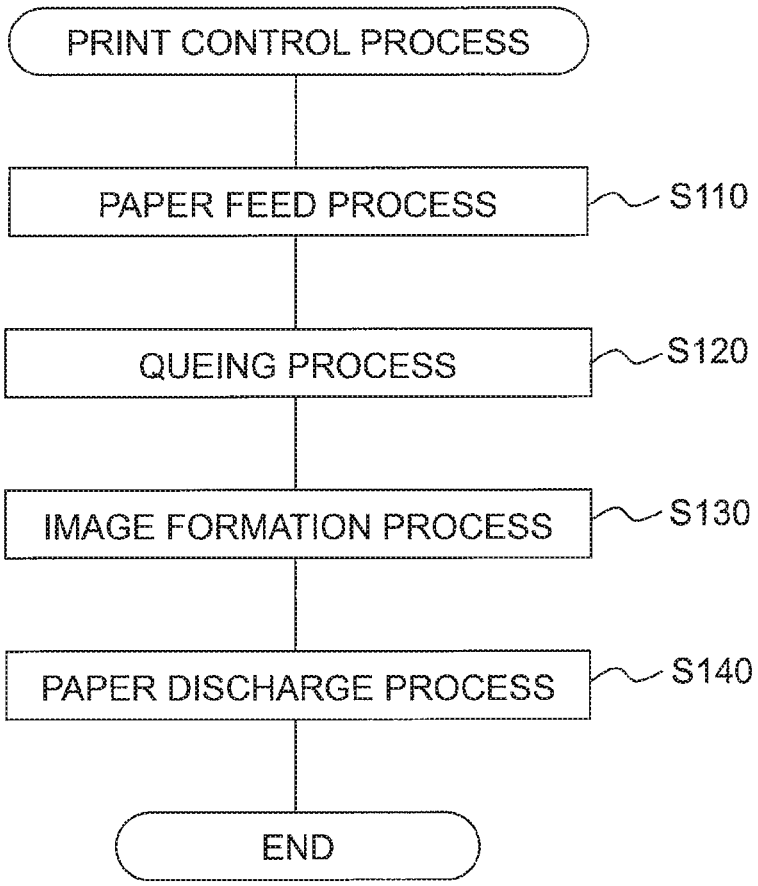
FIG. 3 is a flowchart depicting a print control process to be executed by a main controller.

In particular, on receiving a print target data, the main controller 90 carries out a print control process depicted in FIG. 3. If the print control process is started, then the main controller 90 carries out a paper feed process (S110). In the paper feed process (S110), by inputting a command to the paper feed mechanism 10, the main controller 90 causes the paper feed mechanism 10 to carry out the operation of separating out one sheet of the paper Q from the paper feed tray 21 and transporting the same, and pressing that sheet against the nip portion NP between the conveyance roller 61 and the pinch roller 62. On this occasion, the conveyance roller 61 and the pinch roller 62 are in a stopped state or a reverse rotation state. The reverse rotation state mentioned here refers to such a state that the conveyance roller 61 and the pinch roller 62 rotate in the reverse direction from the direction in which the paper Q nipped in the nip portion NP is transported downstream in the paper transport path.

Thereafter, the main controller 90 carries out a queuing process (S120). In the queuing process, by inputting a command to the recording mechanism 50, the main controller 90 causes the recording mechanism 50 to carry out the operation of downstream transporting the paper Q supplied to the aforementioned nip portion NP. With this inputted command, the recording mechanism 50 rotates the conveyance roller 61 until the head of the paper Q in the image formation target area arrives at the position for the ink jet head 77 to record (the position for the ink jet head 77 to jet the liquid drops of ink).

After finishing the queuing process, the main controller 90 carries out an image formation process (S130). In the image formation process, the recording mechanism 50 is caused to repeatedly carry out the operation of sending out a predetermined length of the paper Q on which such a predetermined size of image is formed as is formable with the ink jet head 77 moving in the main scanning direction. In particular, the recording mechanism 50 is caused to repeatedly carry out the above operation until the image formation is as completed as up to the margin of the image formation target area on the paper Q. Thereafter, the main controller 90 carries out a paper discharge process (S140). In the paper discharge process, the main controller 90 causes the recording mechanism 50 to carry out an operation of discharging the paper Q finished with the image formation into the paper discharge tray.

By carrying out the above paper feed process (S110), queuing process (S120), image formation process (S130), and paper discharge process (S140), the main controller 90 forms and outputs the image on the paper Q, based on the print target data received from the external device.

Figure 4:
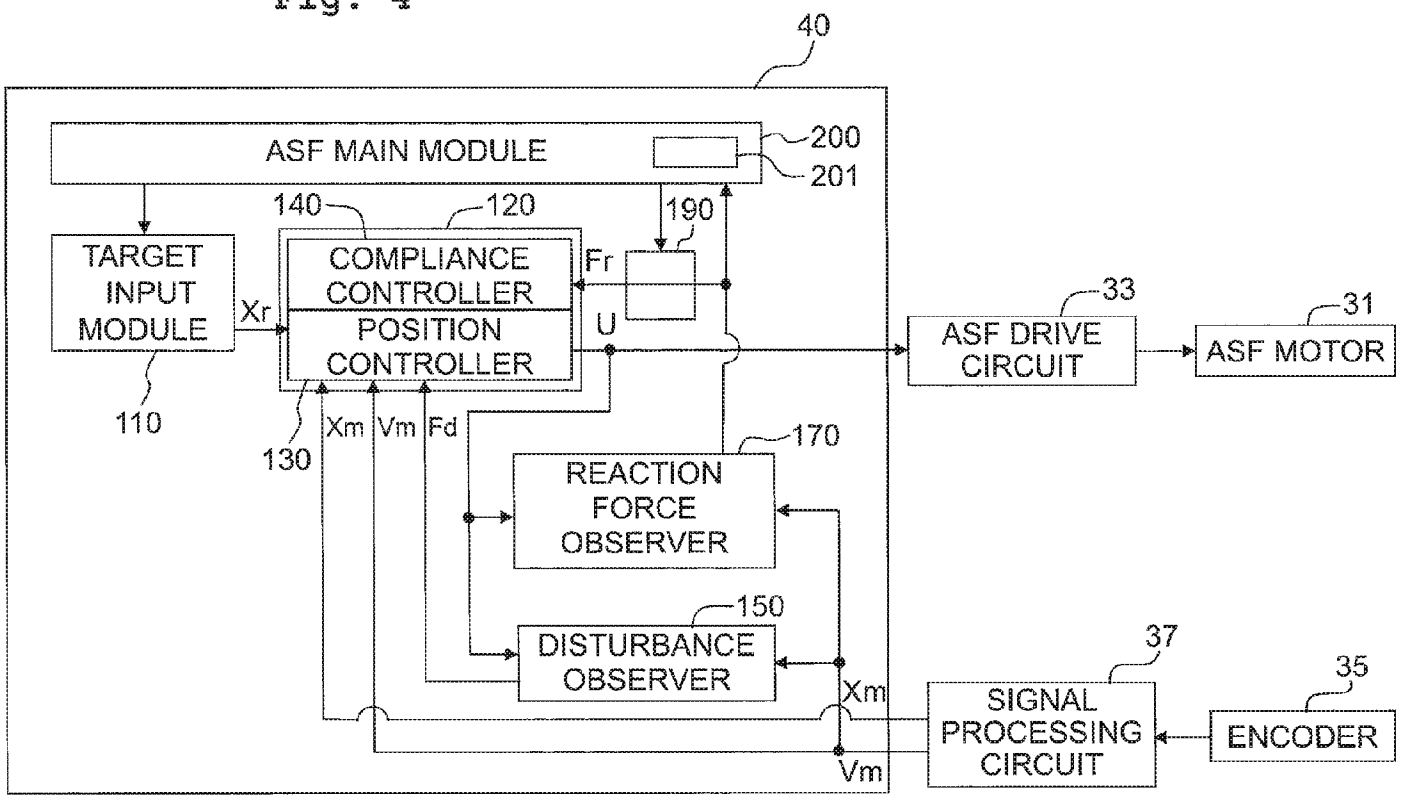
FIG. 4 is a block diagram depicting a detailed configuration of an ASF controller.

Next, FIG. 4 will be used to explain a configuration of the ASF controller 40. Following the command inputted from the main controller 90 when carrying out the paper feed process (S110), the ASF controller 40 controls the ASF motor 31 whereby to realize a transport control or, in particular, a paper feed control of the paper Q. For that purpose, the ASF controller 40 is equipped with a target input module 110, a controller 120, a disturbance observer 150, a reaction force observer 170, a reaction force value input module 190, and an ASF main module 200.

Following a target position trajectory set from the ASF main module 200, the target input module 110 inputs a target position Xr corresponding to a time t to the controller 120, at each time t from the control start time t=0 to the control end time. The target position Xr is the target value for a rotation position X of the paper feed roller 25, and corresponds to the target transport amount of the paper Q. The target position trajectory denotes the target position Xr at each time t from the control start time t=0.

Figure 5A:
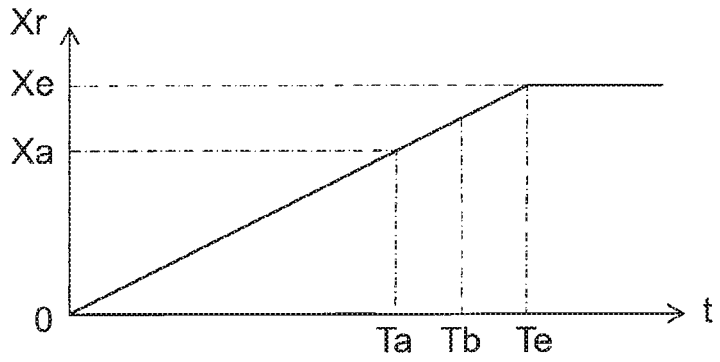
FIG. 5A is a graph depicting a target position trajectory at a control start stage and FIG. 5B is a graph group depicting in the upper part the changed target position trajectory while depicting in the lower part a change in a reaction force estimate value Fr on the same time axis.

As exemplified in FIG. 5A, from the time t=0 to the time t=Te, the target position trajectory, which is set from the ASF main module 200 before starting the paper feed control, changes linearly from the target position Xr=0 to the target position Xr=Xe. Further, after the time=Te, the target position trajectory can be such as to show the constant target position Xr=Xe.

Figure 5B:
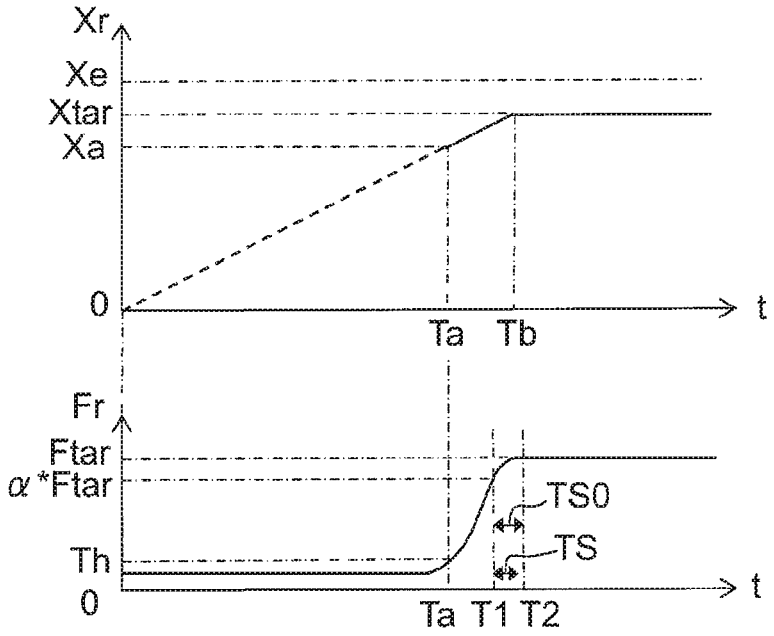

The target position Xr=Xe corresponds to a provisional target stop position, and is set to a value sufficiently larger than a rotation amount of the paper feed roller 25 needed to move the paper Q from the paper feed tray 21 to the nip portion NP. While the details will be described later on, this target position trajectory is changed to such a target position trajectory as exemplified in the upper part of FIG. 5B, to conform with an actual environment in the course of the paper feed control.

The controller 120 calculates the operation amount U corresponding to the target position Xr inputted from the target input module 110, and inputs the calculated operation amount U to the ASF drive circuit 33. The operation amount U corresponds to the current command value. The ASF drive circuit 33 applies a drive current corresponding to the operation amount U inputted from the controller 120, to the ASF motor 31. There is a proportional relation between the drive current of the ASF motor 31 and the force (torque) generated by the ASF motor 31.

To give a detailed description, the controller 120 includes a position controller 130 and a compliance controller 140. The position controller 130 calculates an operation amount Ux based on a deviation between the target position Xr, and the measured position Xm inputted from the signal processing circuit 37. Then, the operation amount Ux is corrected based on a disturbance estimate value Fd inputted from the disturbance observer 150, and the corrected operation amount U is inputted to the ASF drive circuit 33. The compliance controller 140 corrects the operation amount U inputted from the position controller 130 to the ASF drive circuit 33 by a compliance control based on a reaction force estimate value Fr inputted from the reaction force value input module 190.

The reaction force value input module 190 inputs the reaction force estimate value Fr calculated by the reaction force observer 170, to the compliance controller 140. However, the reaction force value input module 190 is controlled by the ASF main module 200 and, in an initial control state (in the period before the time t=Ta depicted in FIG. 5B), not the reaction force estimate value Fr calculated by the reaction force observer 170 but the value zero (Fr=0) is inputted to the compliance controller 140 as a dummy value of the reaction force estimate value Fr.

Figure 6:
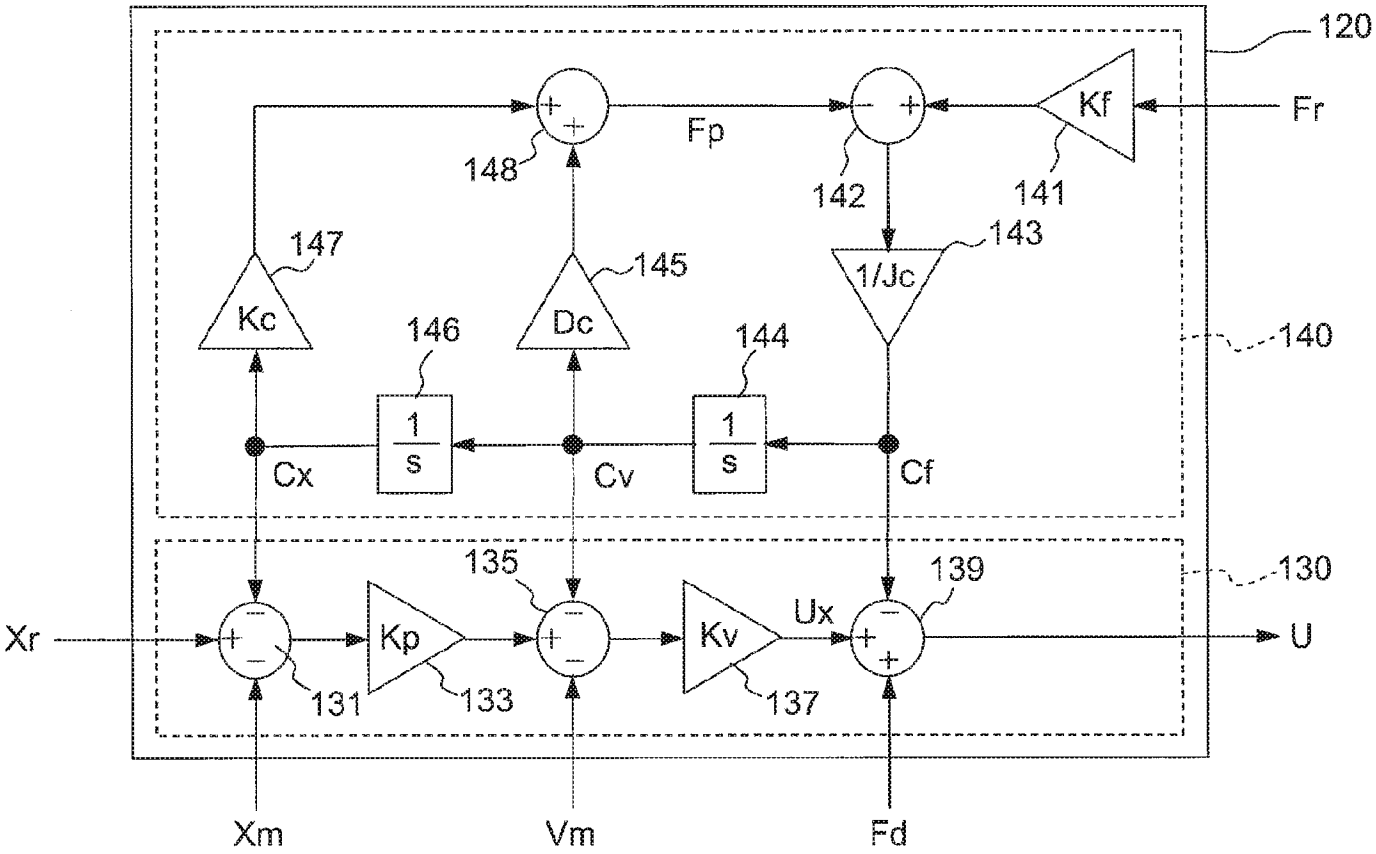
FIG. 6 is a block diagram depicting a detailed configuration of a controller.

The block diagram of FIG. 6 will be used here to explain a detailed configuration of the controller 120. As depicted in FIG. 6, the controller 120 includes addition/subtraction elements 131, 135 and 139 and gain elements 133 and 137 as components of the position controller 130. The addition/subtraction element 131 corrects the deviation (Xr−Xm) between the target position Xr and the measured position Xm with a correction value Cx inputted from the compliance controller 140, and inputs the corrected result to the gain element 133.

The gain element 133 inputs, to the addition/subtraction element 135, a value kp·(Xr−Xm−Cx) having let a gain kp act on the input value (Xr−Xm−Cx) from the addition/subtraction element 131. The addition/subtraction element 135 inputs, to the gain element 137, the value Kp·(Xr−Xm−Cx)−Vm−Cv obtained by correcting the deviation Kp·(Xr−Xm−Cx)−Vm between the input value Kp·(Xr−Xm−Cx) from the gain element 133 and the measured speed Vm corresponding to a differential value of the measured position Xm with the correction value Cv inputted from the compliance controller 140. The gain element 137 inputs, to the addition/subtraction element 139, a value Kv·{Kp·(Xr−Xm−Cx)−Vm−Cv}, as the above operation amount Ux, which has let a gain Kv act on the input value Kp·(Xr−Xm−Cx)−Vm−Cv from the addition/subtraction element 135.

The addition/subtraction element 139 adds the disturbance estimate value Fd to the operation amount Ux from the gain element 137 and, further, inputs the value (Ux+Fd−Cf) to the ASF drive circuit 33 as the operation amount U obtained by correcting the operation amount (Ux+Fd) with the correction value Cf inputted from the compliance controller 140.

Further, the controller 120 includes gain elements 141, 143, 145 and 147, addition/subtraction elements 142 and 148, and integration elements 144 and 146, as components of the compliance controller 140.

The gain element 141 inputs, to the addition/subtraction element 142, a value Kf·Fr which has let a gain Kf act on the input value Fr from the reaction force value input module 190. The addition/subtraction element 142 inputs, to the gain element 143, a deviation Kf·Fr−Fp between the input value Kf·Fr from the gain element 141 and the input value Fp from the addition/subtraction element 148.

The gain element 143 inputs, to the integration element 144 and the addition/subtraction element 139, a value Cf=(Kf·Fr−Fp)/Jc obtained by letting a gain 1/Jc act on the input value Ff·Fr−Fp from the addition/subtraction element 142.

The integration element 144 inputs an integrated value Cv=Cf/s corresponding to the input value Cf from the addition/subtraction element 142, to the gain element 145 and the integration element 146, as well as to the addition/subtraction element 135 of the position controller 130. Further, s denotes the Laplace operator.

The gain element 145 inputs, to the addition/subtraction element 148, a value Dc·Cf/s obtained by letting a gain Dc act on the input value Cv=Cf/s from the integration element 144. The integration element 144 inputs the integrated value $Cx=Cf/s^2$ corresponding to the input value Cv=Cf/s from the integration element 144 to the gain element 147, and the addition/subtraction element 131 of the position controller 130.

The gain element 147 inputs, to the addition/subtraction element 148, a value $Kc\cdot Cf/s^2$ obtained by letting a gain Kc act on the input value $Cx=Cf/s^2$ from the integration element 146. The addition/subtraction element 148 inputs, to the addition/subtraction element 142, an additional value Kc·Cf/

$s^2$+Dc·Cf/s of the input value Kc·Cf/$s^2$ from the gain element 147 and the input value Dc·Cf/s from the gain element 145, as a new value Fp.

The compliance controller 140 inputs the correction values Cx, Cv and Cf to the position controller 130. This input corresponds to correction of the operation amount U inputted from the position controller 130 to the ASF drive circuit 33, according to the function G(s) in the formula (1), in such a direction as to displace target position trajectory (the target position Xr) by a positional correction amount Xc corresponding to the reaction force estimate value Fr.

To make an additional remark, the above gain Kc denotes a virtual spring property between the paper Q and the nip portion NP, and the gain Dc denotes a virtual damper property between the paper Q and the nip portion NP. Further, the value Jc corresponding to the gain (1/Jc) denotes an inertia property of the paper feed device 20 and paper Q, and the gain Kf denotes a correction coefficient of the operation amount U based on the reaction force estimate value Fr. The function G(s) in the formula (1) denotes a correspondence relation between the reaction force estimate value Fr and the correction amount of the operation amount U, for correcting the target position Xr to follow the reaction force received by the paper Q from the nip portion NP.

The correction value Cx corresponds to the positional correction amount Xc, the correction value Cv corresponds to a temporal differentiation of the positional correction amount Xc, and the correction value Cf corresponds to the second order differential of the positional correction amount Xc. During the reaction force estimate value Fr being zero, which is inputted from the reaction force value input module 190 to the compliance controller 140, because the correction values Cf, Cv and Cx are all zero, the compliance controller 140 practically does not function as a device to correct the operation amount U of the position controller 130.

Further, based on the operation amount U inputted to the ASF drive circuit 33 by the controller 120 and the measured speed Vm inputted from the signal processing circuit 37, the disturbance observer 150 calculates, as the disturbance estimate value Fd, the estimate value Fd corresponding to the reaction force acting on the ASF motor 31, and inputs the disturbance estimate value Fd to the addition/subtraction element 139 of the position controller 130.

In addition, based on the operation amount U inputted to the ASF drive circuit 33 by the controller 120 and the measured speed Vm inputted from the signal processing circuit 37, the reaction force observer 170 calculates the reaction force estimate value Fr of the reaction force as the reaction force estimate value Fr excepting the friction component in the reaction force acting on the ASF motor 31, and inputs the reaction force estimate value Fr to the reaction force value input module 190. The reaction force excepting the friction component is a force exerted on the paper Q in the opposite direction from that of transporting the paper Q while the reaction force estimate value Fr is a value corresponding to the vector of that force.

Figure 7:
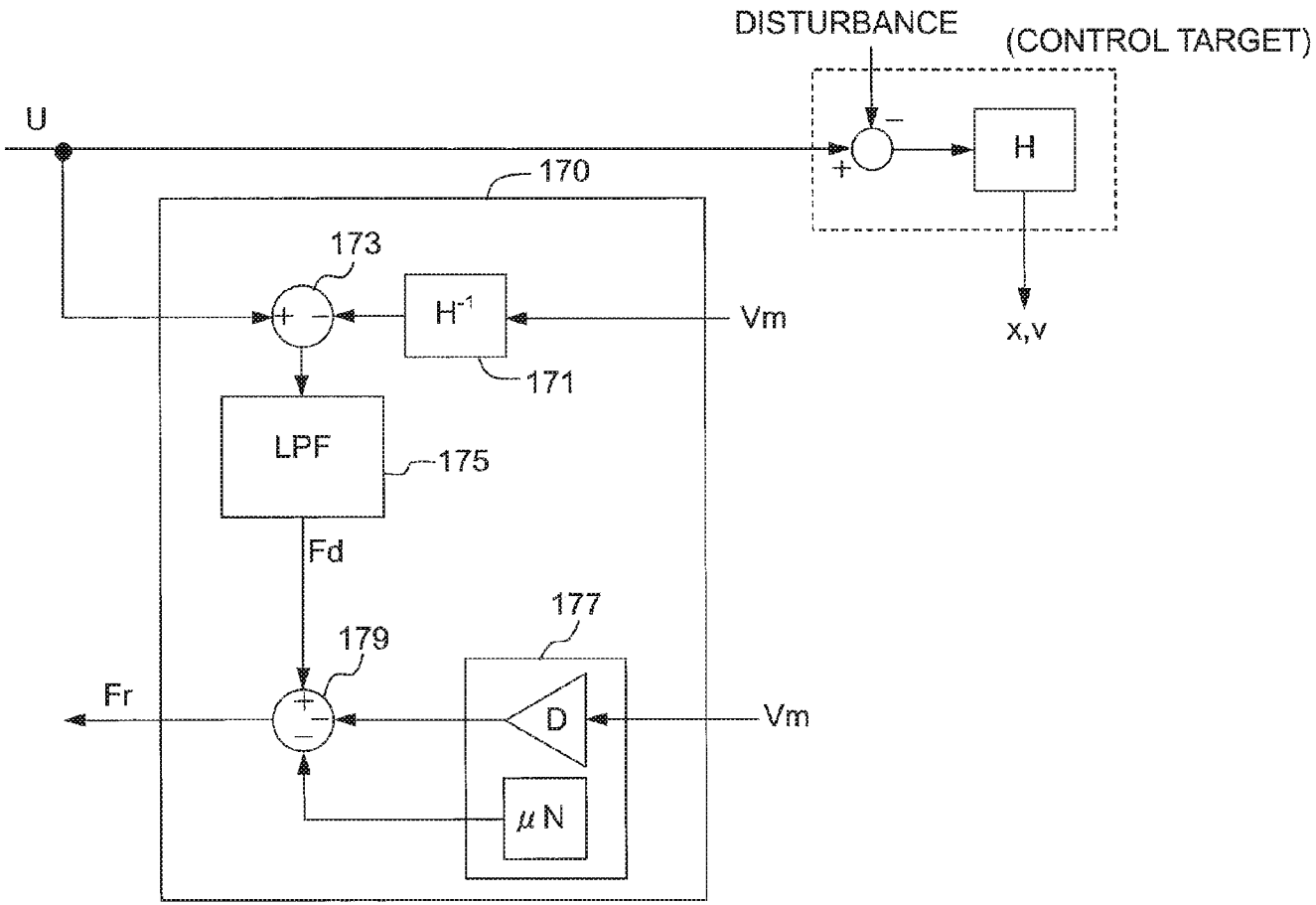
FIG. 7 is a block diagram depicting a detailed configuration of a reaction force observer.

Here, FIG. 7 will be used to explain a configuration of the reaction force observer 170. The reaction force observer 170 includes an inverse model calculation module 171, an addition/subtraction element 173, a low pass filter 175, a friction estimate module 177, and an addition/subtraction element 179.

The inverse model calculation module 171 uses a transfer function $H^{-1}$ of an inverse model corresponding to a transfer model of a control target to transfer the measured speed Vm inputted from the signal processing circuit 37 into the corresponding operation amount U*. The control target mentioned here corresponds to a transfer system from the input of the operation amount U to the ASF drive circuit 33, to the measurement of the control output (position X and speed V) by the signal processing circuit 37.

For example, the transfer function $H^{-1}$ can express and determine an input/output property model H with a rigid model. In particular, the transfer function $H^{-1}$ may be the inverse number $H^{-1}$=(1/K)·s in the case of using a constant number K and the Laplace operator s to express the input/output property model by H=K/s.

The addition/subtraction element 173 calculates the deviation (U−U*) between the operation amount U from the controller 120 and the operation amount U* calculated with the inverse model calculation module 171. The low pass filter 175 removes the high frequency component from the deviation (U−U*). The deviation (U−U*), from which the high frequency component is removed, is inputted to the addition/subtraction element 179 as the disturbance estimate value Fd. The unit of the deviation (U−U*) is the ampere because the operation amount U is a current command value. However, if the drive source is a DC motor, then a proportional relationship holds between the ampere and the torque (reaction force). Therefore, the deviation (U−U*) indirectly denotes the reaction force acting on the control target as a disturbance.

The addition/subtraction element 179 subtracts, from the disturbance estimate value Fd=(U−U*), a friction estimate value (D·Vm+μ·N) inputted from the friction estimate module 177, and inputs the subtracted value Fd−(D−Vm+μ·N) to the reaction force value input module 190 as a reaction force estimate value Fr. This reaction force estimate value Fr is also inputted to the ASF main module 200.

Based on the measured speed Vm, the friction estimate module 177 can calculate an estimate value (D·Vm) of a viscous friction component, due to some lubricant, produced by a rotary shaft included in a power transmission system extending from the ASF motor 31 to the paper Q. The coefficient D corresponds to the viscous friction coefficient. Then, the friction estimate module 177 can calculate the estimate value of the above friction component (D·Vm+μ·N) by adding an estimate value μN of the kinetic friction component to the estimate value of the viscous friction component. The estimate value of the friction component (D·Vm+μ·N) corresponds to the friction component produced in the power transmission system (particularly on the rotary shaft) extending from the ASF motor 31 to the paper Q.

In the same manner as the reaction force observer 170, the disturbance observer 150 is configured to include an inverse model calculation module 171, an addition/subtraction element 173, and a low pass filter 175, and to input the deviation (U−U*), as the disturbance estimate value Fd from which the high frequency component has been removed by the low pass filter 175, to the position controller 130. Because the reaction force observer 170 has the function as the disturbance observer 150, the disturbance observer 150 may not be provided. That is, the ASF controller 40 may be configured to let the reaction force observer 170, instead of the disturbance observer 150, input the disturbance estimate value Fd to the position controller 130.

Figure 8A:
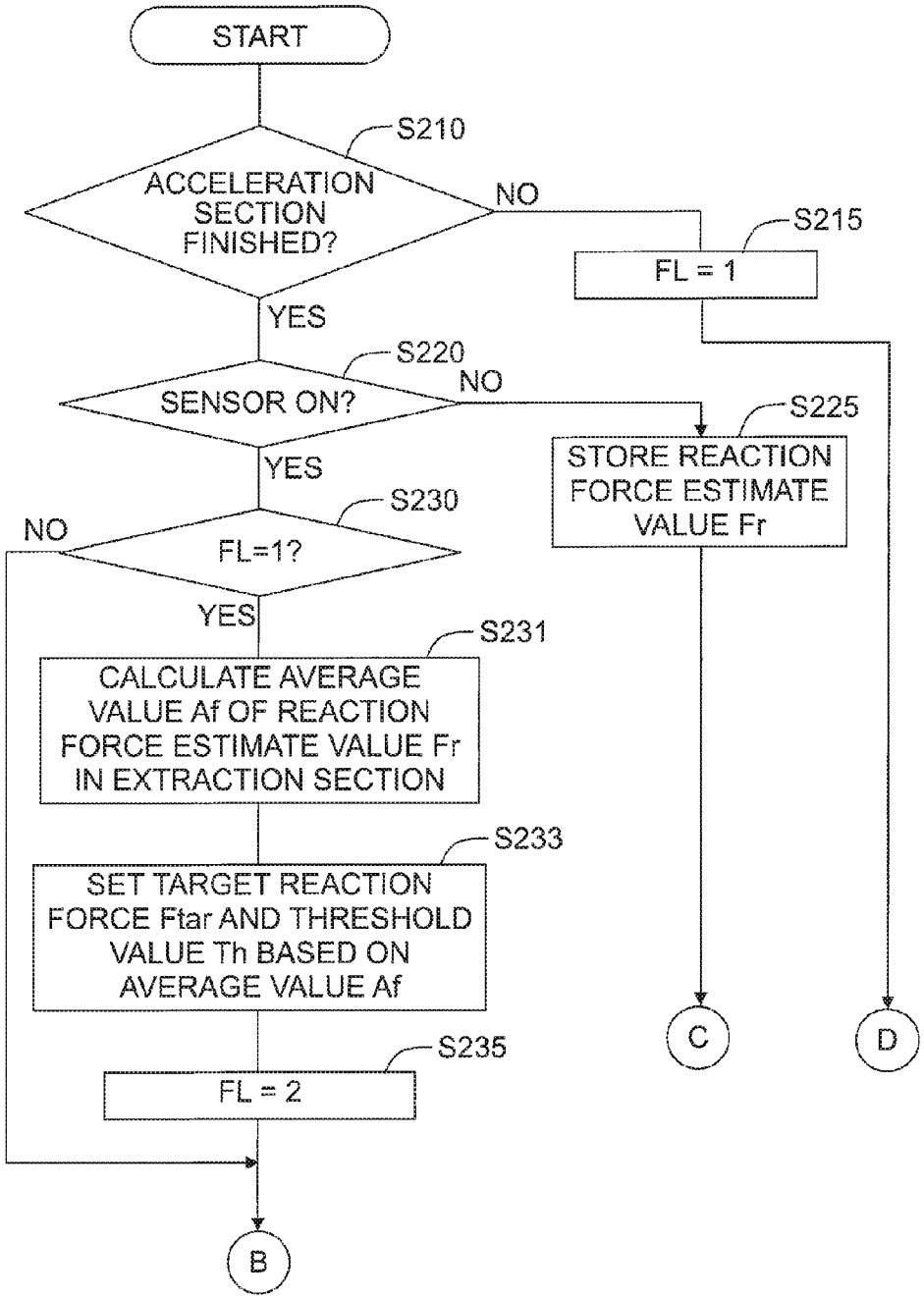
FIGS. 8A and 8B depict a flowchart of a control routine (first half) to be executed by the ASF controller.

Next, the ASF main module 200 will be explained in detail. Following a command inputted from the main controller 90 when carrying out the paper feed process (S110), the ASF main module 200 repeatedly and periodically carries out a control routine depicted in FIGS. 8 and 9. By virtue of this, the paper feed control is realized. When starting the paper feed control, based on the above command, the ASF main module 200 sets the target position trajectory depicted in FIG. 5A for the target input module 110, and activates every part in the ASF controller 40.

On starting the control routine, based on an elapsed time from the control start time t=0, the ASF main module 200 determines whether or not an acceleration section is over (S210). After starting the paper feed control, the paper feed roller 25 is in an acceleration state following the target position trajectory until coming into rotation at a constant rate. The acceleration section mentioned here corresponds to a period from the control start time t=0 to the paper feed roller 25 shifting to the constant rate state.

If the ASF main module 200 determines that the acceleration section is not over (No at S210), then it sets a state value FL to the value 1 (S215). The state value FL has zero as its initial value. The state value FL is updated according to the procession of the paper feed control.

After carrying out the process of S215, the ASF main module 200 shifts the process to S260 to set zero to the input value from the reaction force value input module 190 to the compliance controller 140. By virtue of this, the function of the compliance controller 140 is disabled.

Thereafter, the ASF main module 200 causes the controller 120 to calculate and output the operation amount U based on the current target position Xr, the measured position Xm, the measured speed Vm, and the disturbance estimate value Fd (S270). On this occasion, the disturbance observer 150 calculates the disturbance estimate value Fd. The reaction force observer 170 calculates the reaction force estimate value Fr. The operation amount U has zero as its initial value. The operation amount U calculated by the controller 120 is inputted to the ASF drive circuit 33. By virtue of this, the ASF motor 31 is driven with the drive current corresponding to the operation amount U. Before the acceleration section is over, the control routine is repeatedly carried out through the above steps.

In the control routine after the acceleration section is over, if the positive determination is made in S210, then the ASF main module 200 determines whether or not the input signal is ON from the registration sensor SN to the ASF controller 40 (S220). The registration sensor SN inputs the ON signal if the paper Q is positioned in the detection place of the registration sensor SN, but inputs the OFF signal if the paper Q is not positioned in the above detection place.

If the ASF main module 200 determines that the input signal is OFF from the registration sensor SN (NO at S220), then the reaction force estimate value Fr inputted from the reaction force observer 170 is temporarily stored as the reaction force estimate value Fr used for setting a target reaction force Ftar and a threshold value Th (S225). The reaction force estimate value Fr is retained until the aftermentioned target reaction force Ftar and the threshold value Th are set when the input signal becomes ON from the registration sensor SN. The ASF main module 200 includes a memory 201 for retaining the reaction force estimate value Fr.

If the process at S225 is finished, then the ASF main module 200 carries out S260 and S270 to cause the controller 120 to calculate and output a new operation amount U. After the acceleration section is over, the control routine with the above steps is repeatedly carried out until the input signal switches to ON from the registration sensor SN so as to repeatedly carry out the operation of calculating and outputting the operation amount U, and the operation of letting the memory 201 store the reaction force estimate value Fr.

In the control routine after the input signal switches to ON from the registration sensor SN, the ASF main module 200 gives the positive determination in S220, and carries out the processes from S230.

In S230, the ASF main module 200 determines whether or not the state value FL is the value 1. If the ASF main module 200 determines that the state value FL is not the value 1 but not less than the value 2 (No at S230), then the process shifts to S240.

On the other hand, if the ASF main module 200 determines that the state value FL is the value 1 (Yes at S230), then the target reaction force Ftar and the threshold value Th are set (S231 and S233) based on a group of the reaction force estimate values Fr stored in the memory 201 during the period from the time t=Tc when the acceleration section is over to the time t=Tp when the registration sensor SN switches to the ON signal. Hereinbelow, the period from the time Tc to the time t=Tp is expressed as an extraction section. The extraction section depicted in FIG. 10 corresponds to the section of the reaction force estimate value Fr referenced in setting the target reaction force Ftar and the threshold value Th.

The target reaction force Ftar denotes the reaction force (pressing force) to be realized in correcting the oblique motions by pressing the paper Q against the nip portion NP. The threshold value Th is compared with the reaction force estimate value Fr calculated by the reaction force observer 170, and used for detecting that the paper Q has begun to contact with the nip portion NP.

The reaction force estimate value Fr is, ideally, the value zero before the paper Q contacts with the nip portion NP. However, because the reaction force estimate value Fr is calculated based on a control target model, it contains some error due to the modeling and the like, and thus basically cannot be zero even if the paper Q is not in contact with the nip portion NP. The reaction force estimate value Fr in the extraction section is used for specifying the error component, in other words, the stationary component contained in the reaction force estimate value Fr. The ASF main module 200 specifies an average value Af as the above stationary component by calculating the average value Af of the reaction force estimate value Fr in the extraction section.

Referring to a reaction force threshold table stored in the memory 201, the ASF main module 200 sets the target reaction force Ftar and the threshold value Th based on the calculated average value Af (S233). The reaction force threshold table is stored in the ROM 93 of the main controller 90, and provided from the main controller 90.

Figures 10, 11:
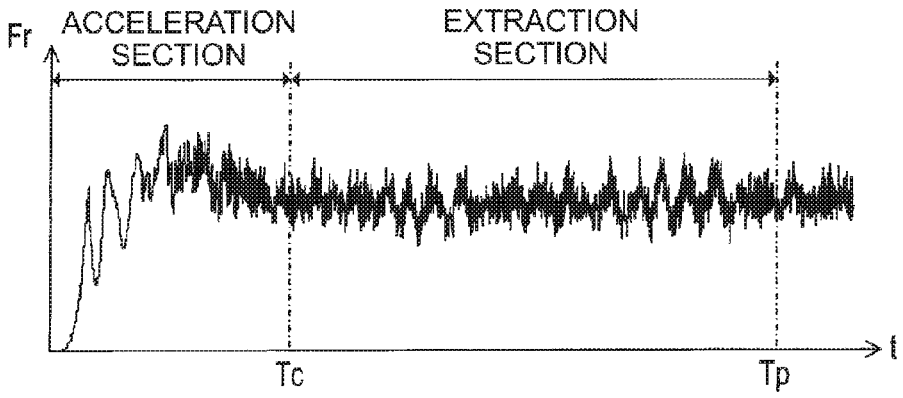
FIG. 10 is a graph depicting a correspondence relation between time change and section of the reaction force estimate value Fr.
FIG. 11 depicts a reaction force threshold value table.

The reaction force threshold table denotes, as depicted in FIG. 11, a target reaction force Ft1 and a threshold value Th1 to be set if the average value Af is less than a value A1, a target reaction force Ft2 and a threshold value Th2 to be set if the average value Af is not less than the value A1 but less than a value A2, and a target reaction force Ft3 and a threshold value Th3 to be set if the average value Af is not less than the value A2. The values Ft1, Ft2 and Ft3 satisfy the relational expression Ft1<Ft2<Ft3, while the values Th1, Th2 and Th3 satisfy the relational expression Th1<Th2<Th3. The threshold values Th1, Th2 and Th3 present values smaller than the corresponding target reaction forces Ft1, Ft2, and Ft3, respectively. That is, the threshold values and the target reaction forces satisfy the relational expression Th1<Ft1, Th2<Ft2, and Th3<Ft3. The threshold values Th1, Th2 and Th3 are set to values larger than a variation range of the value Af.

The larger the average value Af, the larger the target reaction force Ftar and the threshold value Th the ASF main module 200 sets based on the reaction force threshold value table, as the target reaction force Ftar and the threshold value Th according to the level of the average value Af (S233). It is possible to create the reaction force threshold value table by finding an appropriate relation between the average value Af and the target reaction force Ftar and threshold value Th through examinations. If the process of S233 is finished, then the ASF main module 200 updates the state value FL to the value 2 (S235), and shifts the control routine to S240.

In S240, the ASF main module 200 determines whether or not the current reaction force estimate value Fr is larger than the threshold value Th. If the ASF main module 200 determines that the reaction force estimate value Fr is not larger than the threshold value Th (No at S240), then S260 and S270 are carried out to cause the controller 120 to calculate and output a new operation amount U.

In S240, if it is determined that the reaction force estimate value Fr is larger than the threshold value Th (Yes at S240), then the ASF main module 200 determines whether or not an elapsed time TE is less than a predetermined time TE0, the elapsed time TE being counted from the previous time at which the reaction force estimate value Fr exceeded the threshold value Th (S250). In S250, if the ASF main module 200 gives a negative determination if the reaction force estimate value Fr first exceeds the threshold value Th after starting the control or if the elapsed time TE is not less than the time TE0.

If the negative determination is given in S250, then the ASF main module 200 starts to measure the elapsed time TE and stores the target position Xr at the current time (S255). Thereafter, the ASF main module 200 carries out S260 and S270 to cause the controller 120 to calculate and output the new operation amount U.

On the other hand, if it is determined that the elapsed time TE is less than the time TE0 (Yes at S250), then the ASF main module 200 regards that the paper Q has begun to contact with the nip portion NP, and shifts the control routine to S300. That is, the ASF main module 200 shifts the process to S300 on the condition of showing twice the value for the reaction force estimate value Fr to exceed the threshold value Th at an interval shorter than the time TE0. From S300, the ASF main module 200 carries out the processes as for the paper Q being regarded as arriving in the nip portion NP.

Here, if the reaction force estimate value Fr has only exceeded the threshold value Th once, then it is possible for such an event to occur that the reaction force estimate value Fr temporarily exceeds the threshold value Th although the paper Q has not yet arrived in the nip portion NP. Therefore, the paper Q is not regarded as having begun to contact with the nip portion NP. The time TE0 may be set to a short time in a range capable of distinguishing the temporary event from the paper Q having begun to contact with the nip portion NP.

Having shifted the process to S300, the ASF main module 200 determines whether or not the state value FL is the value 2. If it is determined that the state value FL is the value 2 (Yes at S300), then the ASF main module 200 shifts the control routine to S310, whereas if it is determined that the state value FL is not the value 2 but the value 3 (No at S300), then the ASF main module 200 shifts the control routine to S340.

Having shifted the process to S310, the ASF main module 200 sets the target position Xr stored at S255 to a reference position Xa. Here, the target position Xr set to the reference position Xa is the target position Xr at the point (time t=Ta) of the first event occurring among the events where the reaction force estimate value Fr exceeds the threshold value Th twice at a time interval shorter than the aforementioned time TE0. That is, the reference position Xa corresponds to the position where the paper Q has begun to contact with the nip portion NP. As another example, the reference position Xa may be set to be the measured position Xm when the above first event occurs. In this case, the measured position Xm is stored at S255.

After setting the above reference position Xa, the ASF main module 200 calculates a target stop position Xtar capable of realizing the target reaction force Ftar, according to the formula Xtar=Xa+(Kf/Kc)·Ftar (S320). Here, the value Ftar in the formula is the target reaction force Ftar set at S233, and the values Kf and Kc are respectively the gains Kf and Kc in the compliance controller 140. The Xa in the formula is the above reference position Xa.

Referring to the aforementioned formula (1), when the paper Q is finished with being pressed against the nip portion NP, because the differential term can be regarded as zero, it can be appreciated that Xc=(Kf/Kc)·Fr is satisfied. Therefore, when the pressing is finished, the positional correction amount Xc satisfying the target reaction force Ftar is (Kf/Kc)·Ftar. For this reason, if the target stop position Xtar is set to the position Xa+(Kf/Kc)·Ftar advanced by (Kf/Kc)·Ftar from the reference position Xa for the paper Q to begin to contact with the nip portion NP, then it can be appreciated that it is possible to realize the target reaction force Ftar in the target stop position Xtar.

If the target stop position Xtar is set in S320 in this manner, then for the target input module 110, the ASF main module 200 sets the target position trajectory corresponding to the target stop position Xtar as the target position trajectory after the time t=Ta. By virtue of this, it changes the target position trajectory after the time=Ta. That is, as depicted in the upper part of FIG. 5B, the ASF main module 200 sets, for the target input module 110, a new target position trajectory where the target position Xr after a time t=Tb, at which the target position Xr=Xtar, is changed to the target stop position Xtar, based on the unchanged target position trajectory. Thereafter, the ASF main module 200 changes the state value FL to the value 3 (S330), and then shifts the control routine to S370.

Having shifted the process to S370, the ASF main module 200 sets the input value from the reaction force value input module 190 to the compliance controller 140, to the reaction force estimate value Fr made by the reaction force observer 170. By virtue of this, the function of the compliance controller 140 is enabled.

Thereafter, the ASF main module 200 causes the controller 120 to calculate and output the operation amount U based on the current target position Xr, the measured position Xm, the measured speed Vm, and the disturbance estimate value Fd (S380). On this occasion, the operation amount U calculated by the position controller 130 is inputted to the ASF drive circuit 33 as the value corrected by the amount corresponding to the reaction force estimate value Fr made by the compliance controller 140.

In this manner, after the paper Q has begun to contact with the nip portion NP, following the reaction force estimate value Fr made by the compliance controller 140, the corrected operation amount U is inputted to the ASF drive circuit 33. Therefore, the paper Q is moderately pressed against the nip portion NP.

In the control routine after the state value FL is changed to the value 3, if the ASF main module 200 gives a negative determination at S300, then the control routine is shifted to S340. In S340, the ASF main module 200 determines whether or not the reaction force estimate value Fr made by the reaction force observer 170 is not less than the value α·Ftar corresponding to a predetermined fraction of the target reaction force Ftar. The constant α is set at 0.9, for example.

If it is determined in S340 that the reaction force estimate value Fr is less than the value α·Ftar (No at S340), then the ASF main module 200 carries out S370 and S380. On the contrarily, if it is determined that the reaction force estimate value Fr is not less than the value α·Ftar (Yes at S340), then the ASF main module 200 shifts the control routine to S350 to calculate an elapsed time TS from a time t=T1 at which the reaction force estimate value Fr becomes equal to or more than the value α·Ftar. The elapsed time TS is depicted in the lower part of FIG. 5B.

In the control routine up to the point at which the elapsed time TS reaches a predetermined time TS0, the ASF main module 200 gives a negative determination in S360, and carries out S370 and S380. On the other hand, if the above elapsed time TS exceeds the time TS0, then the ASF main module 200 gives a positive determination in S360, and causes the controller 120 to end the calculation of the operation amount U, and changes, to zero, the operation amount U inputted from the controller 120 to the ASF drive circuit 33 (S390).

In this manner, at the point (the time t=T2) when the above elapsed time TS exceeds the predetermined time TS0, the ASF main module 200 stops the ASF drive circuit 33 from driving the ASF motor 31 so as to stop the paper feed device 20 from the operation of transporting the paper Q. Through this process, the ASF controller 40 is finished with the paper feed control, thereby completing the operation of registering the paper Q. Therefore, in this embodiment, the paper Q is pressed against the nip portion NP by a force corresponding to the target reaction force Ftar, and the oblique motions of the paper Q are corrected appropriately.

After the above registration operation is finished, the main controller 90 carries out the queuing process (S120). By virtue of this, the recording mechanism 50 receives a command from the main controller 90 to rotate the conveyance roller 61, thereby transporting the paper Q supplied to the above nip portion NP to a further downstream position.

The image formation system 1 according to the present embodiment was explained above. In the image formation system 1 according to this embodiment, when the paper Q is pressed against the nip portion NP, by the compliance control based on the reaction force estimate value Fr, the operation amount U is appropriately corrected, based on the deviation between the target position Xr and the measured position Xm.

If the paper Q begins to contact with the nip portion NP, then there is an increase in the reaction force acting on the paper Q. According to the above embodiment, by the compliance control, the operation amount U is corrected to follow the reaction force, thereby suppressing the impact acting on the paper Q. Moreover, according to the above embodiment, the reaction force observer 170 is used to realize the compliance control without a physical force sensor.

Especially, the ASF controller 40 in the above embodiment determines that the paper Q has begun to contact with the nip portion NP, based on the reaction force estimate value Fr. Before the beginning of contact, the ASF controller 40 sets the input value for the compliance controller 140, to the value zero (S260) to disable the compliance control. Then, from the beginning of contact, by switching the input value for the compliance controller 140 to the reaction force estimate value Fr made by the reaction force observer 170, correction of the operation amount U is started by way of the compliance control (S370).

Further, the ASF controller 40 sets, to the reference position Xa, the target position Xr or the measured position Xm when the paper Q has begun to contact with the nip portion NP (S310), and sets, to the target stop position Xtar, the location advanced from the reference position Xa by the distance Kf/Kc·Ftar corresponding to the target reaction force Ftar (S320). Therefore, according to the image formation system 1 in the above embodiment, it is possible to press the paper Q against the nip portion NP with an appropriate pressing force corresponding to the target reaction force Ftar, thereby allowing the operation of registering the paper Q to be completed appropriately.

In addition, according to the above embodiment, considering the possibility for the reaction force estimate value Fr persistently not to reach the target reaction force Ftar, the ASF controller 40 stops driving the ASF motor 31 on such a condition that the predetermined time TS0 has elapsed since the reaction force estimate value Fr reached the value (α·Ftar) corresponding to a predetermined fraction of the target reaction force Ftar (S390). Hence, according to the above embodiment, it is possible to suppress unnecessary longtime continuation of the control to reach the target reaction force Ftar.

Further, before the paper Q begins to contact with the nip portion NP, because correction of the operation amount U is not carried out based on the compliance control, it is possible to prevent the compliance control from exerting adverse influences on the paper feed control before the paper Q comes to contact with the nip portion NP, thereby allowing realization of excellent paper feed control of the paper Q.

Further, according to the above embodiment, the target reaction force Ftar and the threshold value Th are set appropriately based on the reaction force estimate value Fr without containing the reaction force component due to the contact between the paper Q and the nip portion NP from a time after the acceleration section is over to another time before the output signal of the registration sensor SN switches to the ON signal. By virtue of this in the above embodiment, it is possible to suppress the adverse influences of some regular components contained in the reaction force estimate value Fr, thereby appropriately pressing the paper Q against the nip portion NP.

Further, according to the above embodiment, the compliance control is started on the condition of showing again the value for the reaction force estimate value Fr to exceed the threshold value Th within the predetermined period TE0 from the point (time t=Ta) of occurrence of the event where the reaction force estimate value Fr exceeds the threshold value Th. Therefore, it is possible to prevent the compliance control from being started by a temporary rise of the reaction force estimate value Fr not caused by the contact between the paper Q and the nip portion NP.

Further, according to the above embodiment, because it is possible to appropriately correct the oblique motions of the paper Q and transport the paper Q in the position for the ink jet head 77 to jet the liquid drops of ink, it is possible to form high quality image on the paper Q, thereby allowing provision of high quality prints to the users.

However, the present teaching is not limited to the above embodiment but can adopt various modified forms. For example, the control routine depicted in FIGS. 8A and 8B may be changed to the control routine depicted in FIGS. 12A and 12B.

Figure 8B:
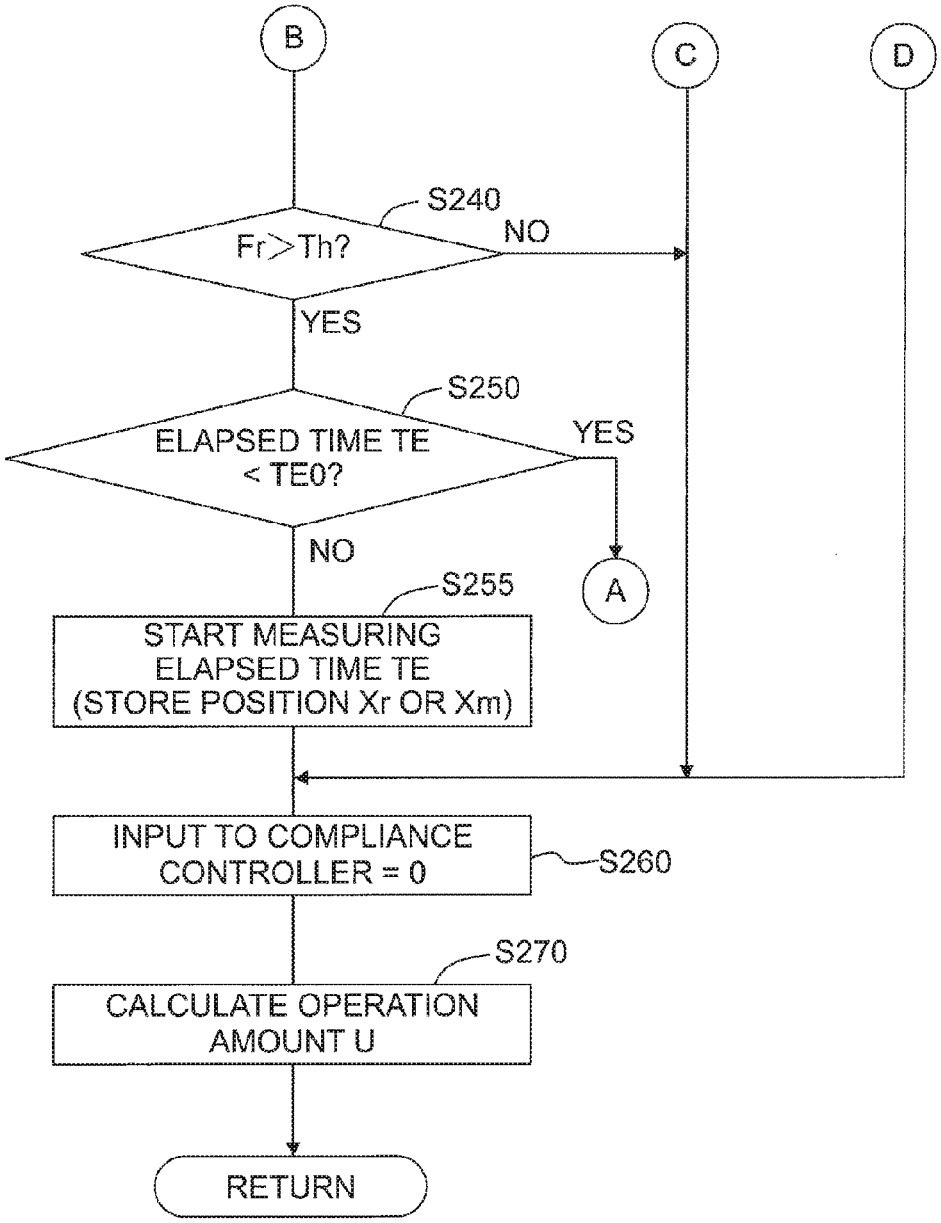
Figure 9:
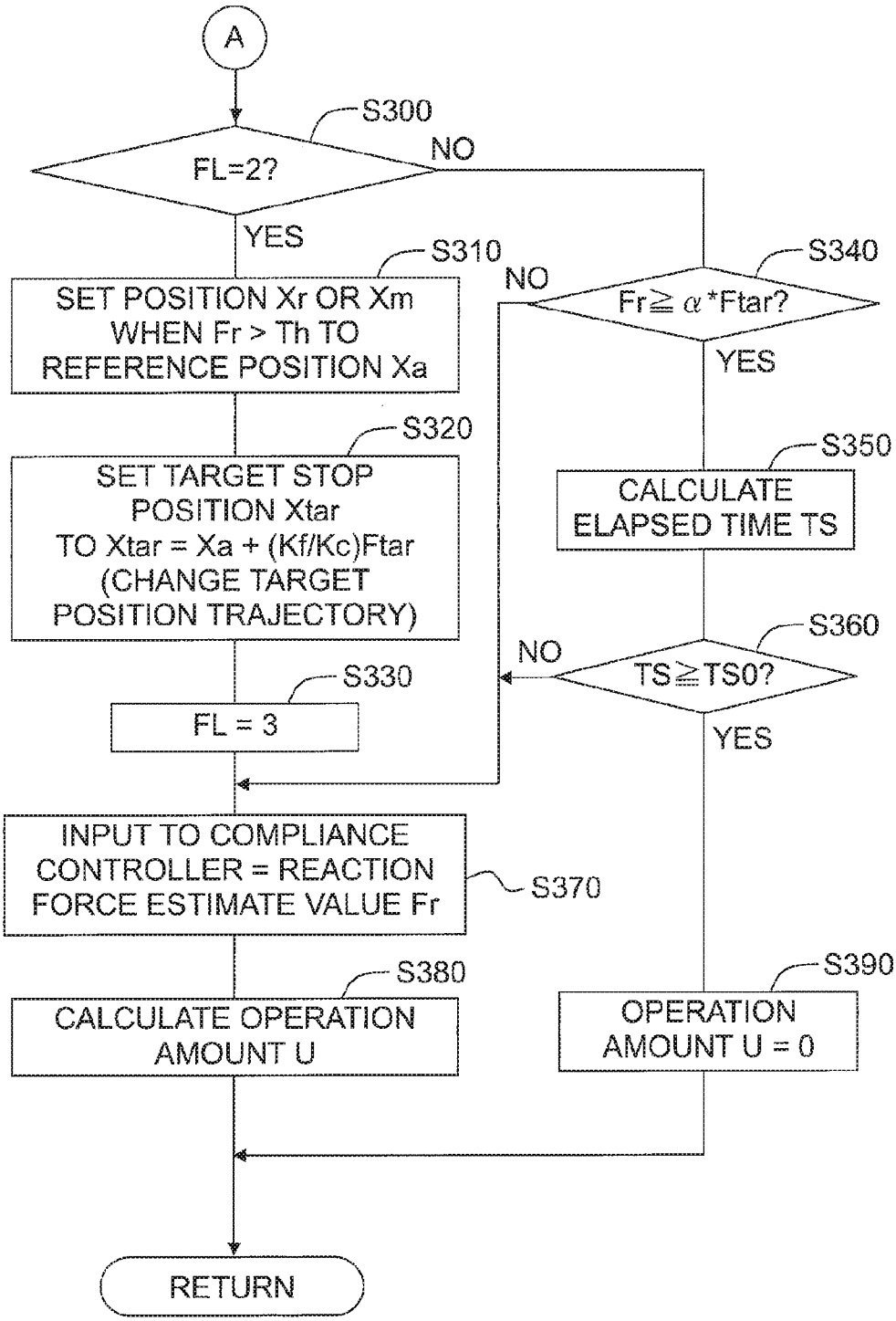
FIG. 9 depicts the flowchart of the control routine (last half).
Figure 12A:
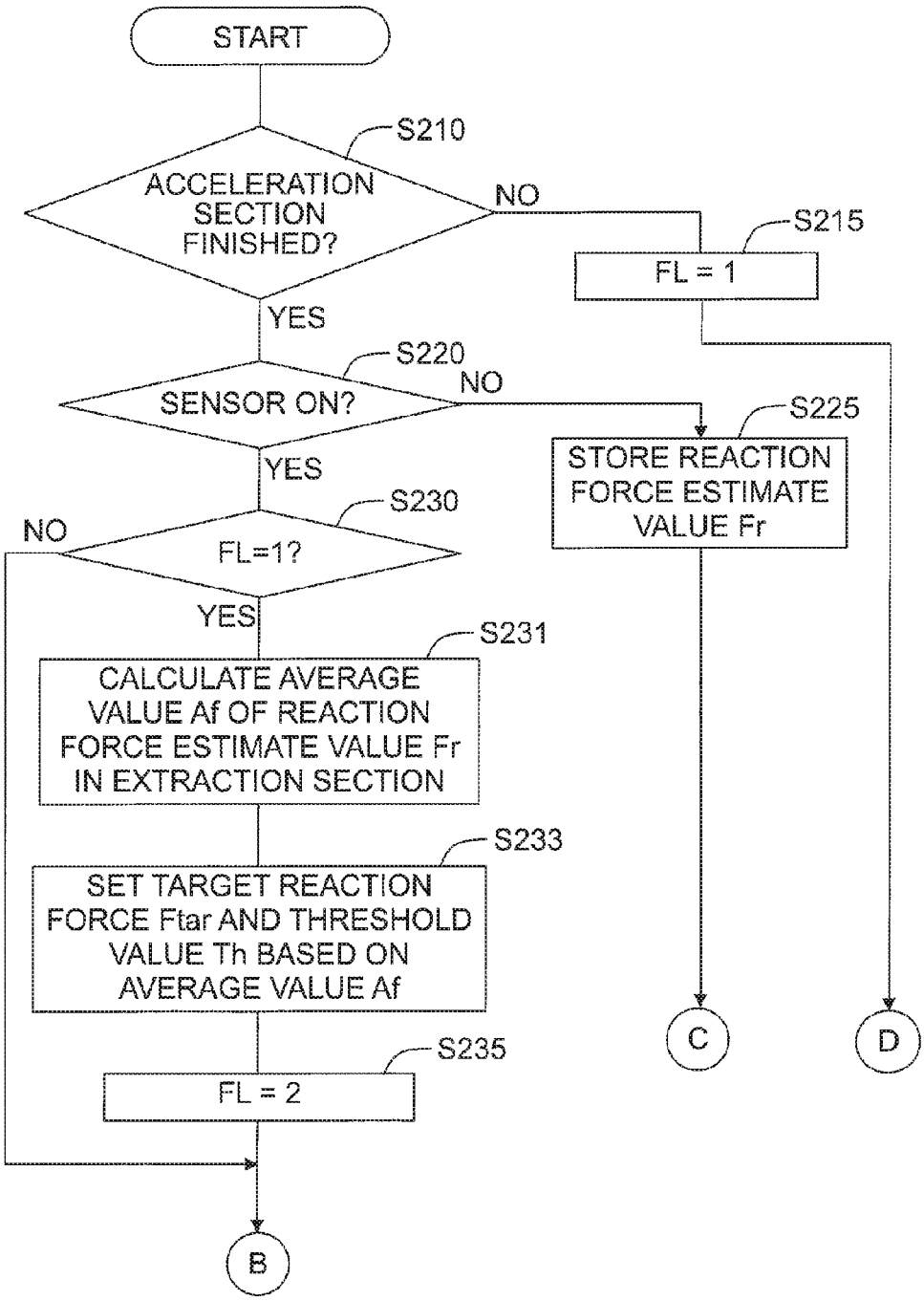
FIGS. 12A and 12B depict a flowchart of a control routine according to a modification of the embodiment.
Figure 12B:
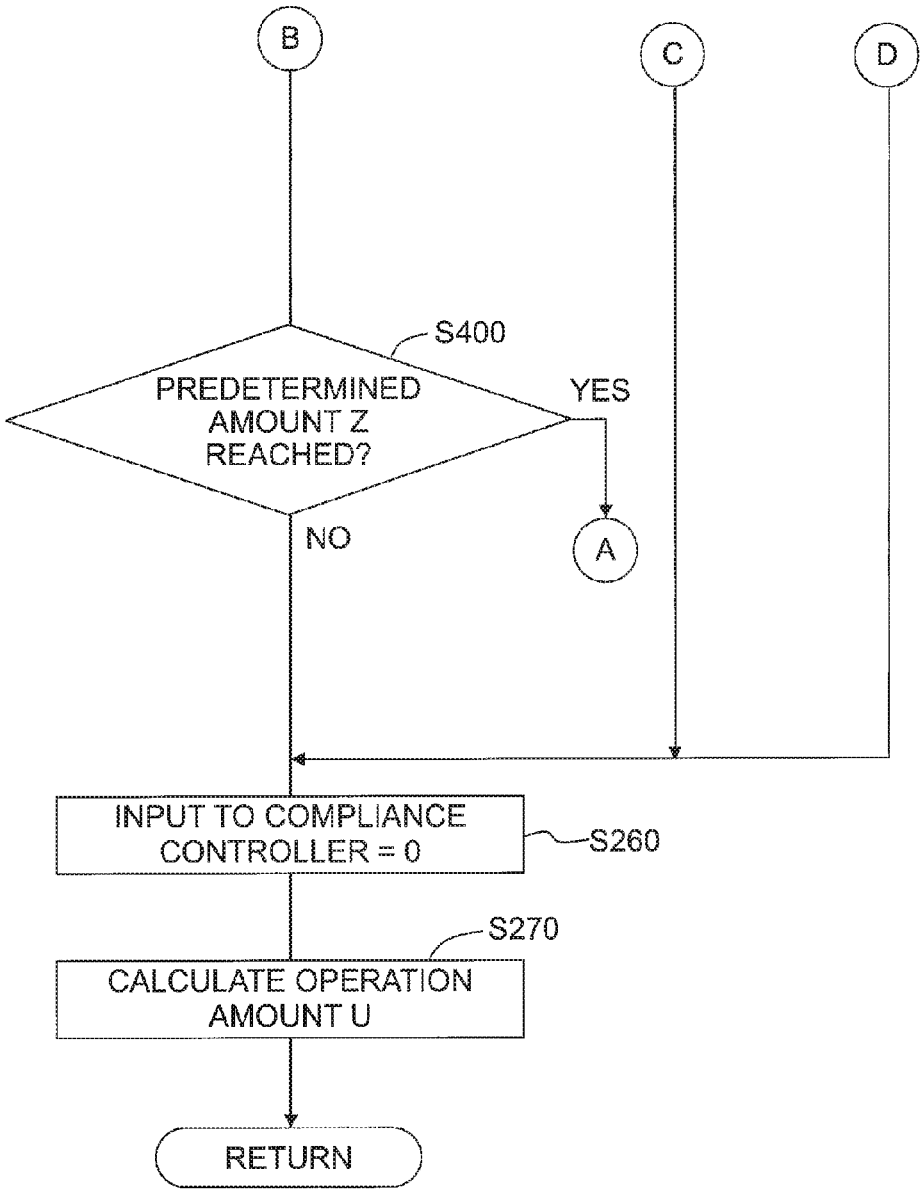

The control routine depicted in FIGS. 12A and 12B is provided with S400 as a determination step to replace S240, S250 and S255 in the control routine depicted in FIG. 8B. According to a modification to carry out the control routine depicted in FIGS. 12A and 12B, the ASF main module 200 shifts the control routine to S400 if it is determined in S230 that the state value FL is not the value 1 (No at S230) or if the state value FL is updated to the value 2 in S235.

In S400, based on the measured position Xm when the input signal from the registration sensor SN switches to the ON signal, and the newest measured position Xm, the ASF main module 200 determines whether or not the rotation amount of the paper feed roller 25 has ever reached a predetermined amount Z since the input signal from the registration sensor SN switched to the ON signal. The predetermined amount Z corresponds to the rotation amount of the paper feed roller 25 needed for the paper Q to contact with the nip portion NP after the paper Q is detected by the registration sensor SN. That is, the predetermined amount Z is set to a value corresponding to a distance L between the nip portion NP, and the place for the registration sensor SN to detect the paper Q.

If it is determined that the rotation amount of the paper feed roller 25 has reached the predetermined amount Z (Yes at S400), then the ASF main module 200 regards that the paper Q has begun to contact with the nip portion NP, and shifts the control routine to S300. On the other hand, the ASF main module 200 gives a negative determination at S400 to carry out S260 and S270 until the paper feed roller 25 comes to rotate at the predetermined amount Z. According to the control routine of this modification, it is also possible to appropriately detect that the paper Q has begun to contact with the nip portion NP, and start the compliance control.

Further, the present teaching may also be used in transport control of the carriage 71. As an image formation system, such a system is known as to transport the carriage 71 on which the ink jet head 77 is mounted while pressing the carriage 71 against a reference wall arranged at an end of the carriage transport path. For example, such a system is also known as to detect the absolute position of the carriage 71 by setting the position of the carriage 71, obtained from an encoder, to the origin, with the carriage 71 pressed against the reference wall. In this system, if the carriage 71 is pressed against the reference wall, then it is possible to yield an impact on the carriage 71 and/or the ink jet head 77.

If the present teaching is applied to the above system, then it is possible to suppress the impact exerted on the carriage 71 and the ink jet head 77 so as to appropriately press the carriage 71 against the reference wall, thereby allowing configuration of an excellent image formation system.

In addition, it is possible to apply the present teaching to various systems which press an abutting object against an abutted object. Embodiments of the present teaching are all aspects included in the technological thought to be specified from the statements set forth in the appended claims.

Finally, an explanation will be made on a correspondence relation between the terms used in the present description. The paper Q corresponds to an example of the abutting object. The conveyance roller 61 and pinch roller 62 correspond to an example of the abutted object. The ASF drive circuit 33 corresponds to an example of the driving device driving the motor (the ASF motor 31) while the rotary encoder 35 and signal processing circuit 37 correspond to an example of the measuring device. The ASF controller 40 corresponds to an example of the controller.

What is claimed is:

1. A control system for pressing an abutting object against an abutted object, the control system comprising:

a mechanical device including a motor and configured to cause a force from the motor to act on the abutting object to displace the abutting object toward the abutted object;

a driving device configured to drive the motor according to an inputted operation amount;

a measuring device configured to measure a physical amount related to displacement of the abutting object; and a controller, wherein the controller is configured to execute:

a position control process to calculate the operation amount to be inputted to the driving device, based on a deviation between a measured position of the abutting object specified from the physical amount measured by the measuring device, and a target position according to a target position trajectory;

a reaction force estimation process to estimate a reaction force acting on the abutting object based on a relationship between the operation amount and the physical amount measured by the measuring device, the reaction force not including a friction component produced in a power transmission system from the motor to the abutting object; and a compliance control process to correct the operation amount which is calculated in the position control process and to be inputted to the driving device, by a compliance control based on an estimate value of the reaction force estimated in the reaction force estimation process, wherein under a condition that a predetermined time has elapsed since the estimate value reached a predetermined ratio to a target reaction force, the controller is configured to further execute a stop control process to control the driving device to stop driving the motor.

2. The control system according to claim 1, wherein in a case that the estimate value satisfies a predetermined condition in accordance with an event where the abutting object has begun to contact with the abutted object, the controller is configured to further execute a position setting process to set a target stop position corresponding to a target reaction force and to newly set the target position trajectory up to the target stop position based on the measured position or the target position.

3. The control system according to claim 2, wherein the controller is configured to start the compliance control process under a condition that the estimate value satisfies the predetermined condition.

4. The control system according to claim 3, wherein the predetermined condition is that the estimate value has exceeded a predetermined threshold value smaller than the target reaction force.

5. The control system according to claim 4, wherein the predetermined condition is that the estimate value exceeds the predetermined threshold value again in a predetermined period from an occurrence of the event that the estimate value has exceeded the predetermined threshold value.

6. The control system according to claim 5, wherein the controller is configured to set the target stop position in the position setting process, based on the measured position or the target position at the occurrence of the event.

7. The control system according to claim 1, wherein under a condition that the estimate value has reached a value corresponding to a target reaction force, the controller is configured to further execute a stop control process to control the driving device to stop driving the motor.

8. The control system according to claim 1, wherein under a condition that the displacement of the abutting object has reached a predetermined stage, the controller is configured to start the compliance control process.

9. The control system according to claim 8, further comprising a sensor arranged between a starting point of the displacement of the abutting object and a point where the abutted object is present, to output a detection signal according to an event where the abutting object has passed therethrough, wherein the controller starts the compliance control process at a point when the displacement amount of the abutting object, which is based on the physical amount measured by the measuring device and is from the time of outputting the detection signal, has reached a value corresponding to a distance from the sensor to the point where the abutted object is present.

10. The control system according to claim 1, wherein the abutting object is a sheet and the mechanical device is configured to cause the force from the motor to act on the sheet so as to convey the sheet toward the abutted object.

11. The control system according to claim 10, wherein the abutted object is a roller configured to rotate with the sheet being nipped and to convey the sheet further downstream in a conveyance direction, and the control system further comprises a processing device configured to execute a predetermined process on the sheet being conveyed downstream in the conveyance direction by the roller.

12. The control system according to claim 1, wherein in the compliance control process, the controller uses the estimate value to correct the operation amount which is calculated in the position control process and is inputted to the driving device, based on a model which denotes a correspondence relation between the estimate value and a correction amount for the operation amount, the model being defined by virtual spring property and damper property between the abutting object and the abutted object, and by an inertia property of the mechanical device and the abutting object.

13. A control system for pressing an abutting object against an abutted object, the control system comprising:

a mechanical device including a motor and configured to cause a force from the motor to act on the abutting object to displace the abutting object toward the abutted object;

a driving device configured to drive the motor according to an inputted operation amount;

a measuring device configured to measure a physical amount related to displacement of the abutting object; and a controller, wherein the controller is configured to execute:

a position control process to calculate the operation amount to be inputted to the driving device, based on a deviation between a measured position of the abutting object specified from the physical amount measured by the measuring device, and a target position according to a target position trajectory;

a reaction force estimation process to estimate a reaction force acting on the abutting object based on a relationship between the operation amount and the physical amount measured by the measuring device, the reaction force not including a friction component produced in a power transmission system from the motor to the abutting object; and a compliance control process to correct the operation amount which is calculated in the position control process and to be inputted to the driving device, by a compliance control based on an estimate value of the reaction force estimated in the reaction force estimation process, wherein in a case that the estimate value satisfies a predetermined condition in accordance with an event where the abutting object has begun to contact with the abutted object, the controller is configured to further execute a position setting process to set a target stop position corresponding to a target reaction force and to newly set the target position trajectory up to the target stop position based on the measured position or the target position, wherein the controller is configured to start the compliance control process under a condition that the estimate value satisfies the predetermined condition, wherein the predetermined condition is that the estimate value has exceeded a predetermined threshold value smaller than the target reaction force, and wherein the controller is configured to further execute a threshold value setting process to extract the estimate value in a period in which reaction force component caused by contact between the abutting object and the abutted object is not contained, and to set the threshold value based on the estimate value which is extracted.

14. The control system according to claim 13, wherein the controller is configured to extract the estimate value within the period except for an acceleration section of the abutting object, in the threshold value setting process.

15. A control system for pressing an abutting object against an abutted object, the control system comprising:

a mechanical device including a motor and configured to cause a force from the motor to act on the abutting object to displace the abutting object toward the abutted object;

a driving device configured to drive the motor according to an inputted operation amount;

a measuring device configured to measure a physical amount related to displacement of the abutting object; and a controller, wherein the controller is configured to execute:

a position control process to calculate the operation amount to be inputted to the driving device, based on a deviation between a measured position of the abutting object specified from the physical amount measured by the measuring device, and a target position according to a target position trajectory;

a reaction force estimation process to estimate a reaction force acting on the abutting object based on a relationship between the operation amount and the physical amount measured by the measuring device, the reaction force not including a friction component produced in a power transmission system from the motor to the abutting object; and a compliance control process to correct the operation amount which is calculated in the position control process and to be inputted to the driving device, by a compliance control based on an estimate value of the reaction force estimated in the reaction force estimation process, wherein in a case that the estimate value satisfies a predetermined condition in accordance with an event where the abutting object has begun to contact with the abutted object, the controller is configured to further execute a position setting process to set a target stop position corresponding to a target reaction force and to newly set the target position trajectory up to the target stop position based on the measured position or the target position, and wherein the controller is configured to further execute a target reaction force setting process to extract the estimate value in a period in which reaction force component caused by contact between the abutting object and the abutted object is not contained, and to set the target reaction force based on the estimate value which is extracted.

16. The control system according to claim 15, wherein the controller is configured to extract the estimate value within the period except for an acceleration section of the abutting object, in the target reaction force setting process.

17. A control system for pressing an abutting object against an abutted object, the control system comprising:

a mechanical device including a motor and configured to cause a force from the motor to act on the abutting object to displace the abutting object toward the abutted object;

a driving device configured to drive the motor according to an inputted operation amount;

a measuring device configured to measure a physical amount related to displacement of the abutting object; and a controller, wherein the controller is configured to execute:

a position control process to calculate the operation amount to be inputted to the driving device, based on a deviation between a measured position of the abutting object specified from the physical amount measured by the measuring device, and a target position according to a target position trajectory;

a reaction force estimation process to estimate a reaction force acting on the abutting object based on a relationship between the operation amount and the physical amount measured by the measuring device, the reaction force not including a friction component produced in a power transmission system from the motor to the abutting object; and a compliance control process to correct the operation amount which is calculated in the position control process and to be inputted to the driving device, by a compliance control based on an estimate value of the reaction force estimated in the reaction force estimation process, wherein in a case that the estimate value satisfies a predetermined condition in accordance with an event where the abutting object has begun to contact with the abutted object, the controller is configured to further execute a position setting process to set a target stop position corresponding to a target reaction force and to newly set the target position trajectory up to the target stop position based on the measured position or the target position, and wherein in the compliance control process, the controller is configured to correct the operation amount, which is calculated in the position control process and is inputted to the driving device, in such a direction as to displace the target position trajectory by a positional correction amount Xc corresponding to a value Fr as the estimate value, according to the following transfer function (s is the Laplace operator):

$$G(s) = \frac{Xc}{Fr} = \frac{Kf}{Jc \cdot s^2 + Dc \cdot s + Kc} \qquad \text{Formula (1)}$$

which includes a value Kc denoting a virtual spring property between the abutting object and the abutted object, a value Dc denoting a virtual damper property between the abutting object and the abutted object, a value Jc denoting an inertia property of the mechanical device and the abutting object, and a correction coefficient Kf.

18. The control system according to claim 17, wherein in the position setting process, in a case that the estimate value satisfies a predetermined condition, the controller is configured to set a position (Xa+(Kf/Kc)·Ftar) as the target stop position corresponding to the target reaction force, based on the target reaction force Ftar and a position Xa, the position Xa being the measured position or the target position at a time when the estimate value satisfies the predetermined condition.

* * * * *